US009032655B2

(12) United States Patent
Spine

(10) Patent No.: US 9,032,655 B2
(45) Date of Patent: May 19, 2015

(54) SEPARABLE MAGAZINE FOLLOWER

(75) Inventor: Marijo Spine, Karlovac (HR)

(73) Assignee: HS Produkt d.o.o., Karlovac (HR)

( * ) Notice: Subject to any disclaimer, the term of this patent is extended or adjusted under 35 U.S.C. 154(b) by 0 days.

(21) Appl. No.: 14/378,355

(22) PCT Filed: Feb. 29, 2012

(86) PCT No.: PCT/HR2012/000006

§ 371 (c)(1),
(2), (4) Date: Aug. 13, 2014

(87) PCT Pub. No.: WO2013/128216

PCT Pub. Date: Sep. 6, 2013

(65) Prior Publication Data

US 2015/0020425 A1 Jan. 22, 2015

(51) Int. Cl.
*F41A 9/70* (2006.01)
*F41A 17/36* (2006.01)

(52) U.S. Cl.
CPC .. *F41A 9/70* (2013.01); *F41A 17/36* (2013.01)

(58) Field of Classification Search
CPC ..... F41A 9/65; F41A 9/70; F41A 9/71
USPC ..... 42/49.01, 50
See application file for complete search history.

(56) References Cited

U.S. PATENT DOCUMENTS

| | | | | |
|---|---|---|---|---|
| 4,811,510 | A | 3/1989 | Chesnut | |
| 5,263,273 | A | 11/1993 | Lishness | |
| 7,318,294 | B2 | 1/2008 | Zimmermann | |
| 8,752,318 | B2 * | 6/2014 | Pulit, Jr. | 42/50 |
| 2006/0236580 | A1 | 10/2006 | Szabo | |

OTHER PUBLICATIONS

Kahr Arms, Kahr part No. KS520, http://www.ammoclip.com/K/kahr_k-40.htm.
MEC-GAR Srl for model Colt 1911 (A1), http://web.archive.org/web/20110103075658/http://www.marstar.ca/ga-mags/images/MG-CG4508PFS-L.jpg.
International Search Report and Written Opinion issued for PCT/HR2012/000006 mailed Nov. 16, 2012.

* cited by examiner

*Primary Examiner* — Reginald Tillman, Jr.
(74) *Attorney, Agent, or Firm* — RatnerPrestia

(57) ABSTRACT

The present invention teaches about a separable magazine follower situated into a magazine body. The magazine follower includes a magazine follower body and exchangeable magazine follower plate. The upper surface of the plate tooth can engage a slide stop lever tooth after the last round is fired from the magazine, and moves a slide stop lever in position that holds a slide in the rear position. The magazine follower plate can be exchanged by the new one after being depleted. The magazine follower plate is not permanently secured to the magazine follower body, but it is nested into the magazine follower body and secured via a magazine spring. The magazine follower plate is formed from material of lower hardness than the material used for slide stop lever tooth in order to prevent its excessive wearing.

6 Claims, 3 Drawing Sheets

SEPARABLE MAGAZINE FOLLOWER

CROSS REFERENCE TO RELATED APPLICATIONS

This application is the U.S. National Phase Application of PCT/HR2012/000006, filed Feb. 29, 2012, the content of such application being incorporated by reference herein.

TECHNICAL FIELD

The present invention relates to a separable magazine follower situated into a magazine body. According to an aspect of the invention, said separable magazine follower is particularly suitable for use with single row ammunition magazines often used with automatic handguns. Therefore, the technical field to which the present invention belongs is related to functional parts or details of small arms, more specifically to magazine parts, and even more specifically to construction of magazine followers.

BACKGROUND OF THE INVENTION

Ammunition magazines with the followers being pushed by a magazine spring are used for a long time, with various kind of arms, and therefore in construction of automatic rifles and guns. A handgun ammunition magazine is usually situated into automatic handgun receiver.

It is well known in the art that after last round being fired from the magazine, a magazine follower engages a slide stop lever in position that holds a slide in the rear handgun position, i.e. open battery position. The engagement of a slide stop lever is performed by the surface specially adapted on a magazine follower.

Regarding the technical requirements to make handguns as light as possible, recently more and more handgun parts are manufactured from polymer materials, optionally further reinforced by glass fibers. The same is common for the field of a magazine follower construction. The technical problem that is observed with single row magazine followers produced of polymer materials is excessive wearing of the surface that engages a slide stop lever, which finally results with the handgun malfunction. Namely, after firing all rounds from a magazine; a slide is not caught in the rear position due to the fact that the surface for engaging a slide stop lever is too depleted to perform its technical function.

The first technical problem solved with the present invention is to protect a follower part that engages a slide stop lever from excessive wearing. In the same time, it enables quick exchange of the magazine follower part which actually activates the slide stop lever and is being excessively worn.

The second technical problem solved with the present invention is the formation of part that engages the slide stop lever with the material that protects the slide stop lever. This ensures smooth operation and reliability of an automatic handgun for a long period.

STATE OF THE ART

In the state of art it is possible to indentify several solutions close to the proposed invention.

The first technical solution, made by the Kahr Arms, is a polymer made magazine follower (Kahr part No. KS520), suitable for the models K40 and P40. It is clearly visible that the metal part which engages a slide stop lever is not detachably connected with the polymer magazine follower.

The second technical solution found in the art, made by the MEC-GAR Srl for the model Colt 1911(A1) .45 ACP 8 rnd., shows the stainless steel magazine and the magazine follower with the metal exchangeable part that prevents excessive wear of the polymer magazine follower at the place where it engages the slide stop lever. The third technical solution is published on Jan. 15, 2008 in the form of granted U.S. Pat. No. 7,318,294 (Zimmermann, A. W.), and it teaches about an ammunition magazine for the rifles and pistols.

The granted claims no. 1-3-4-5, 11-12 and 15-16 of the said document teach about the gun magazine with the polymer made magazine follower lifted by the magazine spring and with the part that engages the slide stop lever reinforced with a metal part. This metal part is not detachably connected with the polymer magazine follower, and can be formed as a plate or a screw as shown on the FIGS. 11 and 15 and described in column 5, rows 56-64; and column 12, rows 30-55 of the same document.

The main difference of the present invention and first mentioned technical solution in the art (Kahr Arm) is that the metal part which prevents excessive wear of the polymer magazine follower cannot be simply replaced. Other technical functions of the cited magazine follower are the same.

In the second technical solution (MEC-GAR Srl) metal part which prevents excessive wear of the polymer magazine follower is replaceable. But, the mentioned part is not replaceable in straightforward manner and is not secured in its nest by the spring follower—as is the case with the solution offered in present invention. It is secured via two wings that enter the nose in the front part of the polymer magazine follower. Other technical functions of the cited magazine follower are the same.

The third technical solution U.S. Pat. No. 7,318,294 does not teach about the change of the part that prevents excessive wear of the polymer magazine follower. This is written in column 5, rows 56-64 and it is visible in the FIG. 11 of the same document. This particular embodiment teaches about the screw additionally secured by the epoxy or glue, or about the metal part casted with the follower polymer body. Other technical functions of the cited magazine follower are the same.

Analyzing the determined prior art it is possible to conclude that some of the existing solutions do not provide the possibility of exchange the metal part that prevents an excessive wearing of the polymer magazine follower body, while another do provide such possibility but not in a straightforward manner. The present invention, with the construction of separable magazine follower, solves all mentioned technical problems in a simple and reliable way.

SUMMARY OF THE INVENTION

The solution of all technical problems is achieved by a separable magazine follower that comprises magazine follower body and exchangeable magazine follower plate inserted into the said body from below. Said magazine follower body has on one of its tops an orifice with edges, where said orifice is a part of a cavity. Additionally, the ribs were formed in the interior of the magazine follower body that serve for receiving and nesting of the magazine follower plate.

The magazine follower plate is positioned into the cavity of the magazine follower body in a way that plate tooth protrudes from the cavity through the orifice relying on the rib with the bottom surface of the plate tooth. The magazine follower plate is secured to the ribs with its upper surface by the force exerted via magazine spring already mounted into the magazine.

The upper surface of the plate tooth is formed to engage a slide stop lever tooth after last round being fired, and moves a slide stop lever in position that holds a slide in the rear position.

Such separable magazine follower enables that the magazine follower plate can be exchanged by the new one after being depleted, and where said magazine follower plate is not permanently secured to the magazine follower body.

The magazine follower plate is preferably formed from material of lower hardness than the material used for slide stop lever tooth in order to prevent its excessive wearing. In practice, magazine follower plate is made of metals, metal alloys or ceramics.

DETAILED DESCRIPTION OF THE INVENTION

The problem with the construction of polymer magazine followers used with automatic handguns is in a demand for magazine followers to activate slide stop lever, and therefore to stop the slide in the rear position, i.e. open battery position. This fact results with the excessive wearing of the surface that engages the slide stop lever tooth.

As described before, the construction of the magazine follower being pressed by the magazine spring, both situated into magazine body is well known in the art. Single row magazines for automatic handguns are usually made of metal and corresponding magazine followers are also made of metal, so excessive wearing of the magazine follower surface that engages slide stop lever is not significant. The problem of excessive wearing of the surface that engages slide stop lever is observed with the polymer magazine followers, especially with single row magazine followers. Namely, with single row magazine followers the surface area that can be used for engaging slide stop lever should be very small in order to allow the normal handgun operation. According to the previous art, it seems that this problem is solved in ad-hoc manner, i.e. by reinforcing the part of the surface by metal plate or piece of metal being in contact with slide stop lever tooth.

Due to the rather small surface metal area, the solutions presented in the art are not easy to maintain or service, especially in case where the metal parts are not detachably connected to the magazine follower body. In case that they are detachably connected with the magazine follower body that solutions have lack of integrity with the magazine follower body. Present invention overcomes observed lack of integrity.

Figure 1:
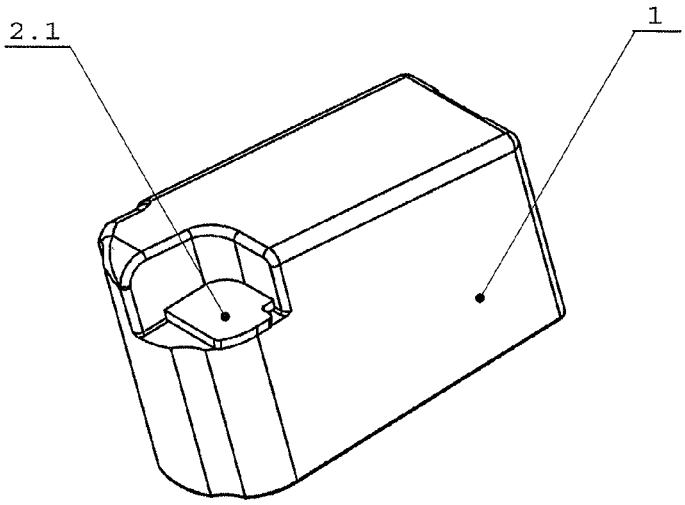
FIG. 1 shows separable magazine follower according to the present invention.

According to an aspect of the present invention, the separable magazine follower is formed from the magazine follower body (1) and the magazine follower plate (2) situated within magazine follower body (1) in the way shown on FIG. 1 where the surface that engages the slide stop lever is the plate tooth (2.1). Magazine follower plate (2) and the corresponding plate tooth (2.1) should be made of metal, metal alloys, ceramic and other acceptable materials. The magazine follower plate is preferably formed from material of lower hardness than the material used for forming slide stop lever tooth in order to prevent its excessive wearing during long time use and to ensure smooth operation and reliability of the automatic handgun for a long period.

Figure 2:
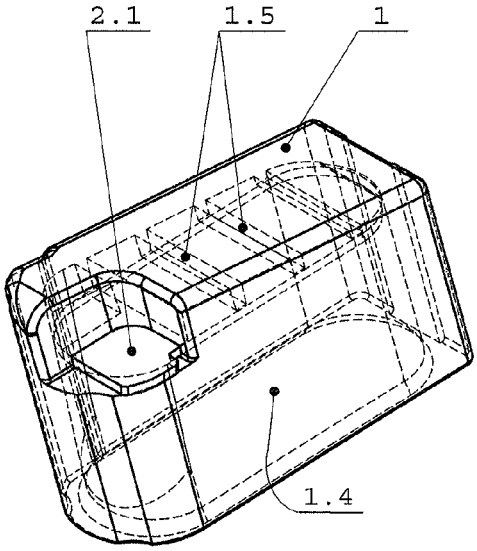
FIG. 2 shows inner structure of the separable magazine follower.
Figure 3:
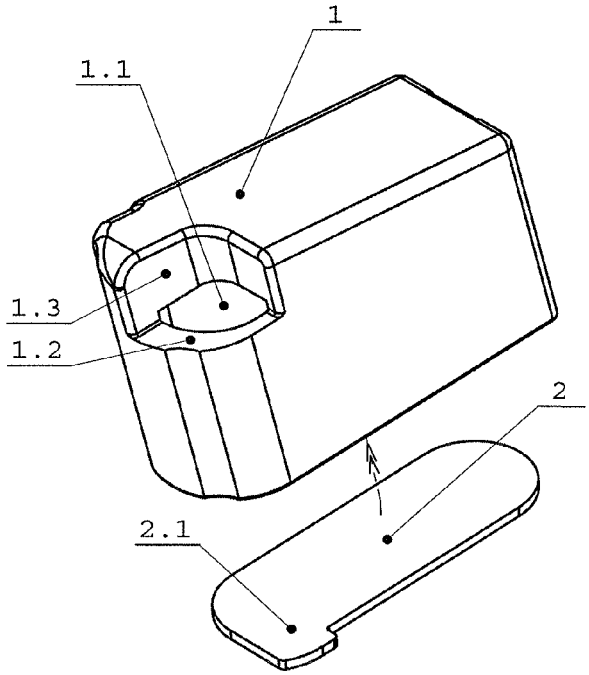
FIG. 3 shows all constitutive parts of the said magazine follower, the magazine follower body and the magazine follower plate.

FIGS. 2 and 3 show the inner structure of the magazine follower body (1) that consists of the centrally situated cavity (1.4) in which the magazine follower plate (2) is inserted. The magazine follower body (1) has the orifice (1.1) where said orifice (1.1) is a part of a cavity (1.4) formed into magazine follower body (1) and where orifice (1.1) is defined by the horizontal edge (1.2) and the vertical edge (1.3) formed on the magazine follower body (1). The orifice (1.1) should be dimensioned in the manner that the plate tooth (2.1) may easily protrude through it. The plate tooth (2.1) with its lower surface relies on the horizontal edge (1.2) of the magazine follower body (1). The magazine follower plate (2) is lying on the ribs (1.5) with its upper surface within the cavity (1.4) as being shown on FIGS. 2 and 5.

Figure 4:
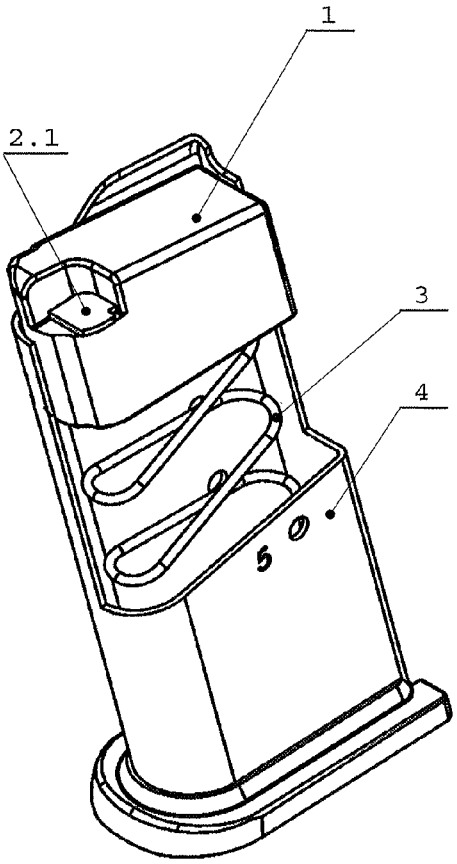
FIG. 4 shows the partially revealed position of said magazine follower within a magazine in order that the magazine spring is visible.
Figure 5:
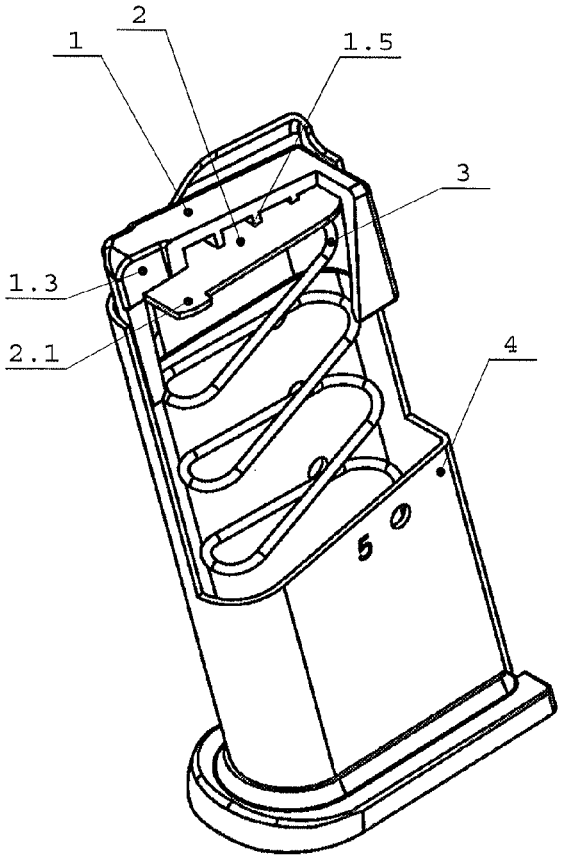
FIG. 5 shows the same as FIG. 4 with the visible cross-section through separable magazine follower in order to show the magazine spring action on the follower.
Figure 6:
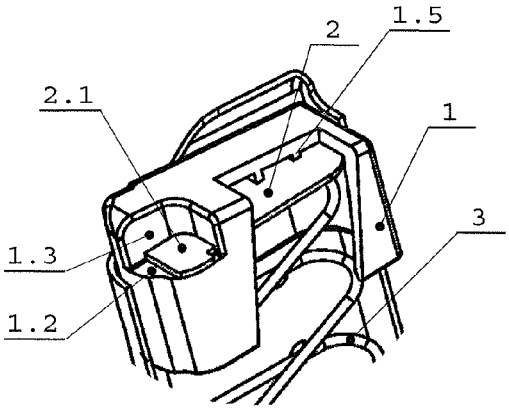
FIG. 6 shows the magazine follower in partial cross-section view.

FIGS. 4 and 5 depict mutual parts position within the ammunition magazine that consists of magazine body (4), magazine spring (3) that presses magazine follower plate onto ribs (1.5) within the magazine follower body (1). Magazine spring (3) action transmits the elastic force to whole magazine follower body (1). In addition, it is visible that the plate tooth (2.1) protects the horizontal polymer edge (1.2) formed on the magazine follower body (1) of excessive wearing. Precise layout of all elements has been shown on FIG. 6 in partially visible cross-section of the magazine follower body (1).

The main characteristic of the present invention is that it enables simple positioning and dismounting of the magazine follower plate (2) within the magazine follower body (1). This is achieved by adequate design of the orifice (1.1) that enables the plate tooth (2.1) to easily protrude through orifice (1.1), especially when the magazine follower plate (2) is rotated by some small angle in comparison with the nested position within the magazine follower body (1). Inner formation of the cavity (1.4) follows the shape of the magazine follower plate (2) and enables that magazine follower plate (2) can be precisely nested in the top of the magazine follower body (1) laying with their upper surface onto the ribs (1.5), as shown on the cross-section on the FIG. 5.

Figure 7:
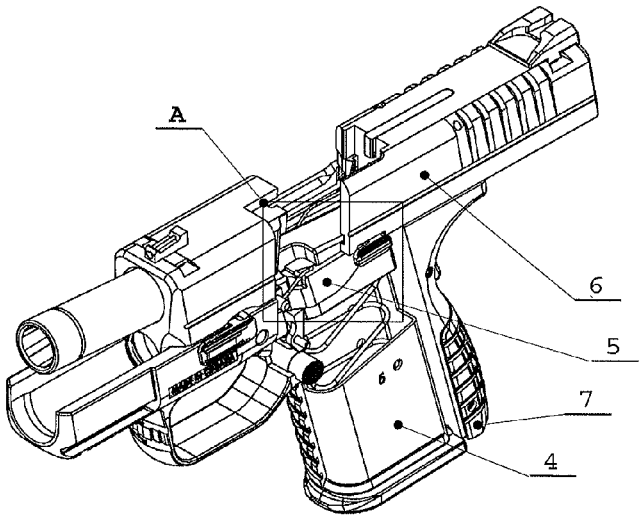
FIG. 7 shows the part of automatic handgun with inserted magazine into a receiver and with the slide in the rear position, all details partially visible through cross-section.
Figure 8:
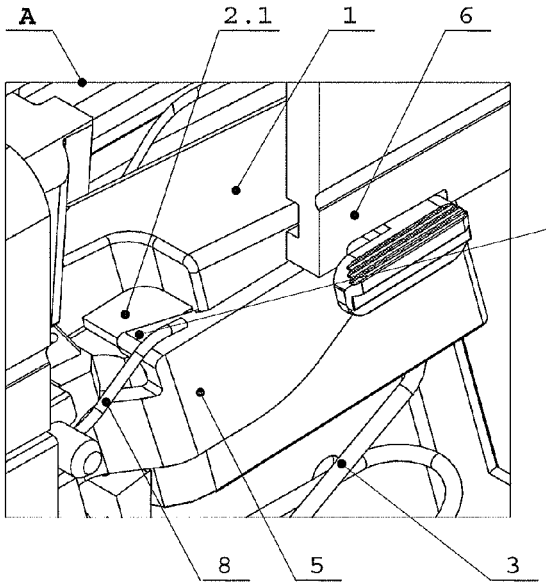
FIG. 8 shows a detail "A" from FIG. 7.
Figure 9:
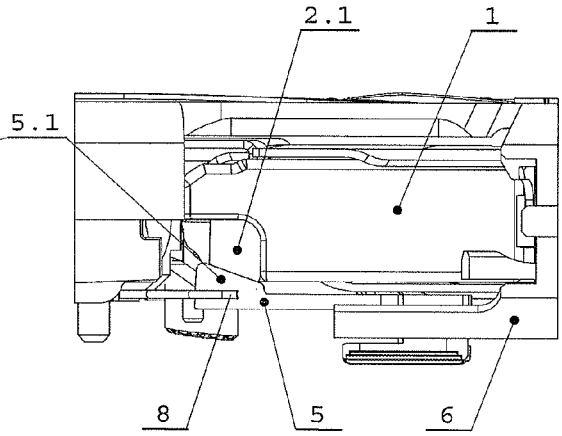
FIG. 9 is the above view onto detail "A" presented on FIG. 7.

The FIG. 7 shows the version of automatic handgun with already inserted magazine body (4) into the receiver (7). The detail denoted with the letter "A" contains a slide stop lever (5) and the slide (6) being caught in the rear position, i.e. empty battery position, after all rounds being fired from the magazine. The FIG. 8 shows enlarged detail "A" depicted on the FIG. 7. When the magazine is not empty, the slide stop lever spring (8) holds the slide stop lever (5) in position that does not affect the slide (6) to return back. After all rounds being fired from the magazine, the plate tooth (2.1) that lays on the horizontal edge (1.2) of the magazine follower body (1), which is pushed by the magazine spring (3), engages the slide stop lever tooth (5.1) enough that the slide stop lever (5) is being in position to catch the slide (6) in the rear position, as depicted in the FIG. 9. From the FIG. 9 it is visible how small the surface of the plate tooth (2.1) is, which actually engages the slide stop lever tooth (5.1) of the slide stop (5), and why the excessive wearing is present in contact of the mentioned parts.

The first technical problem is solved by slowing the excessive wearing of the polymer magazine follower body (1) using the magazine follower plate (2) that can be inserted into the said magazine follower body (1). The second technical problem is solved by using an adequate material of lower hardness for the magazine follower plate (2) than one used for the formation of the slide stop lever tooth (5.1) of the slide stop lever (5). It is possible to contemplate about the magazine follower plate (2) where only the magazine follower plate tooth (2.1) is formed of adequate material, but such construction will be more complex and without any further technical effect for the magazine.

It is worth to note that the separable magazine follower according to the present invention is not designed to last forever. No matter what the choice of material for the magazine follower plate is, it will have limited lifetime. The advantage of the present invention is very simple reparation of the magazine follower by taking out the depleted magazine follower plate, and insertion of the new one that has the technical effect as the whole follower being substituted, which is common practice in the state of art.

INDUSTRIAL APPLICABILITY

The industrial applicability of the present invention is obvious. The present invention teaches about separable magazine follower, especially suitable for use with the single row ammunition magazine usually used with the automatic handguns. The invention solves the technical problem of excessive wearing of the polymer magazine follower during the heavy duty usage, and its fast and reliable reparation.

REFERENCES

1—magazine follower body
1.1—orifice
1.2—edge
1.3—edge
1.4—cavity
1.5—rib
2—magazine follower plate
2.1—plate tooth
3—magazine spring
4—magazine body
5—slide stop lever
5.1—slide stop lever tooth
6—slide
7—receiver
8—slide stop lever spring

The invention claimed is:

1. A separable magazine follower comprises:
a magazine follower body and
an exchangeable magazine follower plate, wherein:
said magazine follower body has at an upper portion thereof an orifice with edges, where said orifice is a part of a cavity formed in the magazine follower body in which formed ribs are provided for receiving and nesting of the magazine follower plate; and
said magazine follower plate is positioned into the cavity of the magazine follower body in such a way that a plate tooth of said magazine follower plate protrudes from the cavity across the orifice, wherein a bottom surface of said plate tooth is positioned on a horizontal edge of the orifice, and where the magazine follower plate is secured to the ribs at an upper surface of the magazine follower plate by a force exerted via a magazine spring.

2. The separable magazine follower according to claim 1 for use with a firearm, wherein an upper surface of the plate tooth can engage a slide stop lever tooth of the firearm after a last round from the magazine is fired, and moves a slide stop lever of the firearm in position that holds a slide of the firearm in the reara rear position.

3. The separable magazine follower according to claim 1, wherein after the magazine follower plate is depleted the magazine follower plate can be exchanged with a replacement magazine follower plate, and wherein said magazine follower plate is not permanently secured to the magazine follower body.

4. The separable magazine follower according to claim 2, wherein the magazine follower plate is made of a material of lower hardness than the materials used for the slide stop lever tooth in order to prevent excessive wearing of the slide stop lever tooth.

5. The separable magazine follower according to claim 4, wherein the magazine follower plate is made of metals, metal alloys or ceramics.

6. The separable magazine follower according to claim 2, wherein after the magazine follower plate is depleted the magazine follower plate can be exchanged with a replacement magazine follower plate, and wherein said magazine follower plate is not permanently secured to the magazine follower body.

* * * * *